US011499123B2

(12) United States Patent
Deflorian et al.

(10) Patent No.: US 11,499,123 B2
(45) Date of Patent: Nov. 15, 2022

(54) WATER SOLUBLE PELLET AND METHOD FOR MANUFACTURING SAID WATER SOLUBLE PELLET

(71) Applicant: ZOBELE HOLDING S.P.A., Trento (IT)

(72) Inventors: Stefano Deflorian, Trento (IT); Cedric Morhain, Trento (IT); Giovanni Carrara, Trento (IT); Silvano Garavaglia, Trento (IT)

(73) Assignee: ZOBELE HOLDING S.P.A., Trento (IT)

( * ) Notice: Subject to any disclaimer, the term of this patent is extended or adjusted under 35 U.S.C. 154(b) by 0 days.

(21) Appl. No.: 16/325,204

(22) PCT Filed: Aug. 16, 2017

(86) PCT No.: PCT/EP2017/070761

§ 371 (c)(1),
(2) Date: Feb. 13, 2019

(87) PCT Pub. No.: WO2018/033571

PCT Pub. Date: Feb. 22, 2018

(65) Prior Publication Data

US 2019/0169549 A1 Jun. 6, 2019

(30) Foreign Application Priority Data

Aug. 17, 2016 (EP) ..... 16184485

(51) Int. Cl.

| | |
|---|---|
| ***C11D 9/00*** | (2006.01) |
| ***C11D 9/02*** | (2006.01) |
| ***C11D 9/10*** | (2006.01) |
| ***C11D 9/22*** | (2006.01) |
| ***C11D 13/18*** | (2006.01) |
| ***C11D 13/22*** | (2006.01) |
| ***C11D 9/44*** | (2006.01) |
| ***C11D 13/08*** | (2006.01) |
| ***C11D 13/10*** | (2006.01) |
| ***C11D 11/00*** | (2006.01) |

(52) U.S. Cl.

CPC ..... *C11D 9/442* (2013.01); *C11D 9/00* (2013.01); *C11D 9/02* (2013.01); *C11D 9/225* (2013.01); *C11D 9/444* (2013.01); *C11D 11/0017* (2013.01); *C11D 13/08* (2013.01); *C11D 13/10* (2013.01); *C11D 13/18* (2013.01); *C11D 13/22* (2013.01)

(58) Field of Classification Search

None

See application file for complete search history.

(56) References Cited

U.S. PATENT DOCUMENTS

| | | | | |
|---|---|---|---|---|
| 3,793,214 A | 2/1974 | O'Neill et al. | ..... | 252/117 |
| 4,082,682 A * | 4/1978 | Inamorato | ..... | C11D 3/06 510/324 |
| 4,198,308 A * | 4/1980 | Micciche | ..... | C11D 1/345 510/324 |
| 4,992,198 A * | 2/1991 | Nebashi | ..... | C11D 3/505 510/101 |
| 6,589,923 B2 * | 7/2003 | Lenuck | ..... | C11D 9/18 510/141 |
| 2009/0082239 A1 * | 3/2009 | Baquete | ..... | C11D 9/26 510/144 |
| 2009/0099055 A1 | 4/2009 | Mayer et al. | ..... | 510/334 |
| 2011/0152146 A1 * | 6/2011 | Denutte | ..... | C11D 3/50 510/119 |

FOREIGN PATENT DOCUMENTS

| | | |
|---|---|---|
| WO | WO 2010/022775 A1 | 3/2010 |
| WO | WO 2013/184981 A2 | 12/2013 |

OTHER PUBLICATIONS

International Search Report dated Nov. 8, 2017 in corresponding PCT International Application No. PCT/EP2017/070761.
Written Opinion dated Nov. 8, 2017 in corresponding PCT International Application No. PCT/EP2017/070761.

* cited by examiner

*Primary Examiner* — Lorna M Douyon
(74) *Attorney, Agent, or Firm* — Ostrolenk Faber LLP

(57) ABSTRACT

A water soluble pellet for releasing one or more actives including a vegetable soap carrier in an amount of 10-95 wt %; a perfume oil in an amount of 2-12 wt %; and a dye in an amount of 0.001 to 0.5 wt %. The method for manufacturing the water soluble pellet includes the following steps: mixing the composition; extruding the composition; and cutting the extruded composition to form water soluble pellets.

7 Claims, No Drawings

WATER SOLUBLE PELLET AND METHOD FOR MANUFACTURING SAID WATER SOLUBLE PELLET

CROSS-REFERENCE TO RELATED APPLICATIONS

The present application is a 35 U.S.C. §§ 371 national phase conversion of PCT/EP2017/070761, filed Aug. 16, 2017, which claims priority to European Patent Application No. 16184485.7, filed Aug. 17, 2016, the contents of which are incorporated herein by reference. The PCT International Application was published in the English language.

The present invention refers to a water soluble pellet and to a method for manufacturing said water soluble pellet, said pellet being able to dissolve in water fast enough to enable the release of one or more actives during product application.

BACKGROUND OF THE INVENTION

It is currently known that some consumers prefer to control the amount of fragrance or perfume added to their laundry independently from the amount of detergent that is used in the washing machine.

This is normally achieved through the use of fabric softeners based on ester quats which are added at a rinse stage, but they have some drawbacks.

For example, these softeners cause the deposition of lime residues through the rinse, they over time accumulate on fabrics and interact negatively with detergent anionic surfactants, which may limit the water absorption of towels, and fabric softeners cause unpleasant deposit in the dispenser of the washing machine.

Therefore, the object of the present invention is to provide a material which solves said drawbacks of the fabric softeners, permitting to protect initially the cloths and then gradually delivering fragrance to the clothes, which can be also manufactured easily in a cost effective way.

DESCRIPTION OF THE INVENTION

The water soluble pellets based on vegetable soap containing high levels of perfume allow to solve current fabric softener drawbacks presenting other advantages that will be described hereinafter.

The water soluble pellets according to the present invention comprises:

a vegetable soap carrier in an amount of 10-95 wt %;

a perfume oil in an amount of 2-12 wt %;

a dye in an amount of 0.001 to 0.5 wt %.

Preferably, the pellets according to the present invention comprises perfume capsules in an amount of 0.5-12 wt % and/or an additional water soluble polymer, such as PEG 6000, in an amount of 5-40 wt %.

According to preferred embodiments, said vegetable soap carrier is made from coconut, olive, rice or corn oils, said dye is bluemarine (but any other suitable dye can be used), and said perfume capsules are made from melamine formaldehyde.

Advantageously, weight of each pellet according to the present invention is from 5 mg to 1 g.

According to a second aspect, the invention also refers to a method for manufacturing water soluble pellets as stated previously, comprising the following steps:

mixing said composition;

extruding said composition; and cutting said extruded composition forming said water soluble pellets.

The water soluble pellet according to the present invention protects initially and then gradually delivers fragrance to the cloths, improving the freshness as per consumer desire, while eliminating the above described drawbacks of fabric softeners.

Furthermore, using the method according to the present invention the pellets can be manufactured in a cost effective way via a suitable extruder that allows to mix ingredients together and extrude them to desired shape and dimensions.

The pellets according to the invention are made by vegetable soap as main water soluble carrier, additional water soluble polymeric carriers and one or more active ingredients. These are homogenously mixed and extruded in pellet of different shapes and dimensions, solid at room temperature.

The pellets are able to dissolve in water fast enough to enable the release of one or more actives during product application.

As first application, we can make vegetable pellets containing high level of perfume oil and encapsulated perfume to be used as fragrance booster for laundry applications.

This will enable to delight consumers with the level of fragrance they want on fabrics without the drawback of the current fabric softeners.

DESCRIPTION OF A PREFERRED EMBODIMENT

According to the invention, the pellet comprises a vegetable soap carrier (10 to 95 wt %) perfume oil (2 to 12 wt %), perfume capsules (0 to 12 wt %) and a dye (0.001 to 0.5 wt %), and it is soluble in water at 30° C. under 500 rpm stirring simulating washing machine conditions in less than 20 minutes, preferably less than 10 minutes, and even more preferably less than 5 minutes.

A first example of the invention is:

Coconut soap beads: 92.95 wt %

Perfume oil: 5 wt %

Perfume capsules (made preferably from melamine formaldehyde shell): 2 wt %

Dye (such as bluemarine): 0.05 wt %

It must be pointed out that instead of coconut, rice, corn or olive can also be used, or any suitable vegetable soap.

The above materials are mixed together via an extruder and delivered in the form of solid pellets of mass 5 mg to 1 g each. It must be pointed out that the normal dose per wash in a washing machine would be between 10 grams and 25 grams formed by a plurality of pellets.

This material has been tested for water solubility according to the following protocol:

pour into a beaker about 50 ml of water;

warm up it until get 30° C.:

put about 250 mg of pellets into the beaker mixing continuously at 500 rpm via magnetic stirrer;

wait until all the pellet is dissolved.

We demonstrated this water soluble pellets dissolve completely in less than 5 minutes.

The use of the extruder allows to provide a shape to the final pellets in the form of stars, hearths, flowers or any other 2D object shape, which can be implemented to the nozzle of the extruder.

This allows to design the shape which best fit with the perfume fragrance and/or the brand/artwork design, making enjoyable the consumer experience.

Furthermore, the extrusion allows producing pellets with a skin/core structure, and surface hardness allows pellets to be extruded without sticking on themselves during their production and storage.

Additionally, some of the vegetable soap polymer should provide softness effect to fabrics but avoiding drawbacks of fabric usual softeners.

An alternative preferred composition of the pellets can be:

Coconut soap beads: 70 wt %

Palm soap: 20 wt %

Perfume oil: 7 wt %

Perfume capsules (made preferably from melamine formaldehyde shell): 2.95 wt %

Dye (pink from millkan): 0.05 wt %

The use of a second vegetable soap as palm soap or olive soap can help tailoring:

1) mechanical or surface properties of the final pellets, and/or 2) the solubility properties and/or improve the extrusion process.

A third preferred composition can be:

Coconut soap beads: 60 wt %

PEG 6000: 30 wt %

Perfume oil: 7 wt %

Perfume capsules (made preferably from melamine formaldehyde shell): 2-95 wt %

Dye (pink from millkan): 0.05 wt %

In the third alternative embodiment, the water soluble polymer is added to improve flowability during process (e.g. polyethylene glycol (PEG) 6000) (5 to 40 wt %).

PEG addition allows to improve mechanical properties, as well as to help better mixing of the fragrance in the material.

In the composition of the water soluble pellets according to the present invention, other fabric care active ingredient components can be added to be released through the wash together or alternatively to perfume providing consumer fabrics with additional benefits. These actives could be but not limited to stain removal ingredients, whitening agents as huying dyes and optical brighteners, lime removals additive, color care ingredients, softener agents, anti-wrinkles polymers, etc.

Additionally, the water soluble pellets made of vegetable soap could be used for release of actives in contact with water in other categories as for example in personal care (shampoo, conditioners, skin care, etc.).

Additionally, some other kind of additives could be added to the formulation. On one side, some additives can be added with the purpose to make the pellets less sticky and make the dosification by the user easier. For example, moisture absorbent additive such as Sodium sulfate or magnesium sulfate can be used.

Another kind of additive, still with the purpose to make the pellets less sticky are water soluble fillers such as sodium chloride or potassium chloride or calcium chloride.

Finally, additive to make dissolution during the washing cycle faster can be used, such as natural cellulose fibers, microcrystalline cellulose, or sodium carboxy methyl cellulose or hydroxypropyl cellulose.

An example of formulation with these kinds of additives is:

Coconut soap 48%

Sodium Sulfate 20%

Sodium Chloride 15%

Microcystalline cellulose 10%

Fragrance 4%

Microcapsules 3%

In addition to that, typical stabilizer/antioxidants additives can be added in order to stabilize the formulation and avoid its degradation with time.

Even though reference is made to a specific embodiment of the invention, it is clear for a person skilled in the art that the disclosed pellets and method are susceptible of variations and modifications, and that all the details cited can be substituted by other technically equivalent ones, without departing from the scope of protection defined by the attached claims.

The invention claimed is:

1. A water soluble pellet for releasing one or more actives, comprising:

a vegetable soap carrier in an amount of 10-95 wt %;

a perfume oil in an amount of 2-12 wt %;

a dye in an amount of 0.001 to 0.5 wt %;

polyethylene glycol in an amount of 15-40 wt % at least one water soluble filler selected from the group consisting of sodium chloride, potassium chloride and calcium chloride; and at least one additive selected from the group consisting of natural cellulose fibers, microcrystalline cellulose, sodium carboxymethyl cellulose and hydroxypropyl cellulose.

2. The water soluble pellet according to claim 1, wherein said vegetable soap carrier is made from coconut, olive, rice or corn soaps or a mixture of two or more of them.

3. The water soluble pellet according to claim 1, further comprising perfume capsules in an amount of 0.5-12 wt %.

4. The water soluble pellet according to claim 3, wherein said perfume capsules are made from melamine formaldehyde.

5. The water soluble pellet according to claim 1, wherein said water soluble pellet has a weight from 5 mg to 1 g.

6. The water soluble pellet according to claim 1, wherein the water soluble pellet is soluble in water at 30° C. under stirring conditions in less than 20 minutes.

7. A method for manufacturing a water soluble pellet according to claim 1, comprising the following steps:

mixing a composition according to claim 1;

extruding said composition; and cutting said extruded composition so as to form said water soluble pellets.

* * * * *